US006506282B2

(12) United States Patent
Hu et al.

(10) Patent No.: US 6,506,282 B2
(45) Date of Patent: Jan. 14, 2003

(54) STEAM EXPLOSION TREATMENT WITH ADDITION OF CHEMICALS

(75) Inventors: Sheng-Hsin Hu, Appleton, WI (US); Tong Sun, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/775,919

(22) Filed: Feb. 2, 2001

(65) Prior Publication Data

US 2001/0020520 A1 Sep. 13, 2001

Related U.S. Application Data

(63) Continuation-in-part of application No. 09/467,219, filed on Dec. 20, 1999, now abandoned.
(60) Provisional application No. 60/114,284, filed on Dec. 30, 1998.

(51) Int. Cl.[7] ..... D21C 5/02; D21H 11/14
(52) U.S. Cl. ..... 162/5; 162/68; 162/78; 162/90
(58) Field of Search ..... 162/4, 5, 9, 21, 162/18, 52, 247, 63, 100; 428/357

(56) References Cited

U.S. PATENT DOCUMENTS

| | | | |
|---|---|---|---|
| 1,578,609 | A | 3/1926 | Mason |
| 1,586,159 | A | 5/1926 | Mason |
| 1,655,618 | A | 1/1928 | Mason |
| 1,793,711 | A | 2/1931 | Mitscherling |
| 1,824,221 | A | 9/1931 | Mason |

(List continued on next page.)

FOREIGN PATENT DOCUMENTS

| | | | |
|---|---|---|---|
| CA | 798208 | | 11/1968 |
| CA | 919468 | | 1/1973 |
| CA | 1070537 | | 1/1980 |
| CA | 1070646 | | 1/1980 |
| CA | 1119033 | | 3/1982 |
| CA | 1138708 | | 1/1983 |
| CA | 1170487 | | 7/1984 |
| DE | 0 044 471 | | 9/1887 |
| DE | 0 492 795 | | 1/1926 |
| DE | 0 559 405 | | 9/1927 |
| DE | 559405 | * | 9/1927 |
| DE | 0 714 937 | | 11/1941 |
| DE | 0 935 502 | | 10/1955 |
| DE | 0 969 167 | | 4/1958 |
| DE | 1 047 413 | | 12/1958 |
| DE | 1 051 624 | | 2/1959 |
| DE | 1 105 702 | | 4/1961 |
| DE | 4 316 861 | A1 | 11/1994 |
| EP | 0 038 373 | A1 | 10/1981 |
| EP | 0 153 182 | A2 | 8/1985 |
| EP | 0 172 135 | A1 | 2/1986 |
| EP | 0 284 585 | A2 | 9/1988 |
| EP | 0 346 559 | A2 | 12/1989 |
| EP | 0 403 068 | A2 | 12/1990 |
| EP | 0 501 059 | A1 | 9/1992 |
| EP | 0 434 851 | B1 | 8/1994 |
| EP | 0 446 556 | B1 | 8/1995 |
| EP | 0 487 793 | B1 | 8/1995 |
| FR | 1 000 674 | | 2/1952 |
| FR | 1 026 696 | | 4/1953 |
| FR | 2 544 222 | | 10/1984 |
| GB | 0 374 047 | | 5/1932 |
| GB | 0 945 127 | | 12/1963 |
| GB | 2 000 822 | A | 1/1979 |
| GB | 1 547 550 | | 6/1979 |
| JP | 403279471 | * | 10/1991 |
| JP | 06065862 | * | 11/1994 |
| WO | WO 87/01402 | A1 | 3/1987 |
| WO | WO 92/10606 | A1 | 6/1992 |
| WO | WO 94/12719 | A1 | 6/1994 |
| WO | WO 95/20065 | A1 | 7/1995 |
| WO | WO 97/04162 | A3 | 2/1997 |
| WO | WO 98/27269 | A1 | 6/1998 |
| WO | WO 98/27269 | * | 6/1998 |

OTHER PUBLICATIONS

TAPPI Official Test Method T 203 om–88, "Alpha–, Beta–, and Gamma–Cellulose in Pulp," published by the TAPPI Press, Atlanta, Georgia, revised 1988, correction 1992, pp. 1–3.

TAPPI Official Test Method T 220 om–88, "Physical Testing of Pulp Handsheets," published by the TAPPI Press, Atlanta, Georgia, revised 1988, pp. 1–4.

TAPPI Official Test Method T 227 om–92, "Freeness of Pulp," published by the TAPPI Press, Atlanta, Georgia, revised 1992, pp. 1–7.

TAPPI Official Test Method T 230 om–89, "Viscosity of Pulp (Capillary Viscometer Method)," published by the TAPPI Press, Atlanta, Georgia, revised 1989, pp. 1–6.

TAPPI Historical Method T 236 hm–85, "Kappa Number of Pulp," published by the TAPPI Press, Atlanta, Georgia, revised 1985, pp. 1–3.

TAPPI Classical Method T 254 cm–85, "Cupriethylenediamine Disperse Viscosity of Pulp (Falling Ball Method)," published by the TAPPI Press, Atlanta, Georgia, correction 1990, pp. 1–7.

Casey, J.P., "Pulp and Paper; Chemistry and Chemical Technology, 3rd edition, vol. I", John Wiley & sons, New York, 1980, pp. 25, 25, 411–421.

Karaivanova, S. et al., Paperchem Abstract AB3907662, "Preparation of Carboxymethylcellulose for the Textile Industry From Beechwood Prehydrolysis Kraft Pulp," *Khim. Ind.* (Sofia) 37, No. 2, pp. 49–54.

(List continued on next page.)

*Primary Examiner*—Dean T. Nguyen
(74) *Attorney, Agent, or Firm*—Gregory E. Croft

(57) ABSTRACT

Virgin fibers or de-inked recycled fibers modified by steam explosion in the presence of certain chemicals are able to form handsheets with higher bulk while substantially retaining strength and brightness.

16 Claims, No Drawings

U.S. PATENT DOCUMENTS

| | | | | | |
|---|---|---|---|---|---|
| 1,872,996 | A | | 8/1932 | Mason | |
| 1,906,885 | A | | 5/1933 | Richter | |
| 1,922,313 | A | | 8/1933 | Mason | |
| 1,979,341 | A | | 11/1934 | Olsen | |
| 1,996,797 | A | | 4/1935 | Dreyfus | |
| 2,234,188 | A | * | 3/1941 | Morgan | 92/11 |
| 2,516,847 | A | | 8/1950 | Boehm | |
| 2,517,577 | A | | 8/1950 | Klug et al. | |
| 2,524,024 | A | | 9/1950 | Swinehart et al. | |
| 2,539,990 | A | | 1/1951 | Chapman et al. | |
| 2,539,991 | A | | 1/1951 | Chapman | |
| 2,583,994 | A | | 1/1952 | Shelton | |
| 2,636,879 | A | | 4/1953 | Branan et al. | |
| 2,639,281 | A | | 5/1953 | Hodge et al. | |
| 2,645,577 | A | | 7/1953 | Bate et al. | |
| 2,711,369 | A | | 6/1955 | Birdseye et al. | |
| 2,878,118 | A | | 3/1959 | Rogers et al. | |
| 2,882,965 | A | | 4/1959 | Wayman et al. | |
| 2,904,460 | A | | 9/1959 | Nolan | |
| 2,961,041 | A | | 11/1960 | Lesniak | |
| 2,976,278 | A | | 3/1961 | Paddison et al. | |
| 2,999,783 | A | | 9/1961 | Terai et al. | |
| 3,085,087 | A | | 4/1963 | Henry et al. | |
| 3,251,824 | A | | 5/1966 | Battista | |
| 3,347,855 | A | | 10/1967 | Nelson | |
| 3,544,422 | A | | 12/1970 | Huff et al. | |
| 3,567,573 | A | | 3/1971 | Case | |
| 3,617,433 | A | | 11/1971 | Sutherland | |
| 3,632,469 | A | | 1/1972 | Wilder | |
| 3,652,387 | A | | 3/1972 | Wilder | |
| 3,707,436 | A | * | 12/1972 | O'Connor | 162/9 |
| 4,091,205 | A | | 5/1978 | Onda et al. | |
| 4,163,687 | A | | 8/1979 | Mamers et al. | |
| 4,250,305 | A | | 2/1981 | Saito et al. | |
| 4,361,463 | A | | 11/1982 | Lindberg et al. | |
| 4,401,813 | A | | 8/1983 | Lowell et al. | |
| 4,431,479 | A | * | 2/1984 | Barbe et al. | 162/9 |
| 4,488,932 | A | | 12/1984 | Eber et al. | |
| 4,645,541 | A | | 2/1987 | DeLong | |
| 4,668,340 | A | | 5/1987 | Sherman | |
| 4,710,187 | A | | 12/1987 | Boland et al. | |
| 4,762,521 | A | | 8/1988 | Roessler et al. | |
| 4,770,656 | A | | 9/1988 | Proxmire et al. | |
| 4,798,603 | A | | 1/1989 | Meyer et al. | |
| 4,798,651 | A | | 1/1989 | Kokta | |
| 4,898,642 | A | | 2/1990 | Moore et al. | |
| 4,908,099 | A | | 3/1990 | DeLong | 162/21 |
| 4,971,658 | A | | 11/1990 | Henricson et al. | |
| 4,976,819 | A | | 12/1990 | Minton | 162/9 |
| 4,995,943 | A | | 2/1991 | Rehberg | |
| 5,021,122 | A | | 6/1991 | Desrochers et al. | |
| 5,102,501 | A | | 4/1992 | Eber et al. | |
| 5,122,228 | A | | 6/1992 | Bouchette et al. | |
| 5,135,612 | A | | 8/1992 | Desrochers et al. | |
| 5,247,072 | A | | 9/1993 | Ning et al. | |
| 5,262,003 | A | * | 11/1993 | Chupka et al. | 162/4 |
| 5,262,004 | A | | 11/1993 | Gilbert et al. | |
| 5,382,610 | A | | 1/1995 | Harada et al. | |
| 5,399,240 | A | | 3/1995 | Graf et al. | 162/9 |
| 5,550,189 | A | | 8/1996 | Qin et al. | |
| 5,731,083 | A | * | 3/1998 | Bahia et al. | 428/393 |
| 5,843,852 | A | * | 12/1998 | Dutkiewicz et al. | 442/334 |
| 6,413,362 | B1 | | 7/2002 | Hu | 162/4 |

OTHER PUBLICATIONS

Naterova, A. et al., Paperchem Abstract AB4408005, "Conditions for the Preparation Of Carboxymethylcellulose—(1) Effect of the Agent Dose and Reaction Time," *Vyskum. Pr. Odboru Papiera Celulozy*, 18: V49–53 (1973).

Owczarzak, J., Paperchem Abstract AB6304383, "Properties of Beechwood (Fagus) Dissolving Pulp Manufactured With Acid–Steam Prehydrolysis," *Przegl. Papier*, 47, No. 10: 353–355, Oct. 1991.

Rydholm, Sven, A., "Pulping Processes," Interscience Publishers, 1965, pp. 588, 618.

Rydholm, Sven A., "Pulping Processes," Interscience Publishers, 1967, pp. 39.

American Society for Testing Materials (ASTM) Designation: D 588–42, "Alpha–, Beta–, and Gamma–Cellulose inPaper," pp. 286–291, published as tentative from 1940 to 1942.

TAPPI Official Test Method T 200 om–89, "Laboratory Processing of Pulp (Beater Method)," published by the TAPPI Press, Atlanta, Georgia, revised 1989, pp. 1–5.

Cole, Barbara J.W. and Kyosti V. Sarkanen, "Bleaching and Brightness Stabilization of High–Yield Pulps By Sulfur–Containing Compounds," *Tappi Journal*, Nov. 1987, pp. 117–122.

Crawford, R.J. et al., "Laboratory Studies of Chloroform Formation In Pulp Bleaching," *Tappi Journal*, Nov. 1987, pp. 123–128.

Janson, Jan and Ingegerd Forsskahl, "Color Changes In Lignin–Rich Pulps On Irradiation By Light", *Nordic Pulp and Paper Research Journal*, No. 3, vol. 4, Oct. 1989, pp. 197–205.

Karaivanova, S. et al., Paperchem Abstract AB3907662, "Preparation of Carboxymethylcellulose For The Textile Industry From Beechwood Prehydrolysis Kraft Pulp," *Khim. Ind.* (Sofia) 37, No. 2, 1965, pp. 49–54.

Naterova, A. et al., Paperchem Abstract AB4408005, "Conditions For The Preparation Of Carboxymethylcellulose –(1) Effect of the Agent Dose and Reaction Time," *Vyskum. Pr. Odboru Papiera Celulozy*, 18: V49–53 (1973).

Owczarzak, J., Paperchem Abstract AB6304383, "Properties of Beechwood (Fagus) Dissolving Pulp Manufactured With Acid–Steam Prehydrolysis," *Przegl. Papier*, 47, No. 10:353–355, Oct. 1991.

Rydholm, Sven A., "Pulping Processes,"Interscience Publishers, 1965, pp. 588–618.

Rydholm, Sven A., "Pulping Processes, "Interscience Publishers, 1965, pp. 654–672.

Triana, C. J.; Lopez Diaz, A.A., Paperchem Abstract No. AB4503360, "Preparation and Evaluation of Carboxymethylcellulose From Pulp From Sugar Cane Gagasse," Cuba Azucar, Jan. Mar. 1972, pp. 46–58.

Yur'eva, M. K.; Dolmatova, V.A.; Petropavlovskii, G.A., Paperchem Abstract No. AB4802190, "Fibrous Sheet Materials Based on Carboxymethylcellulose," Khim. Drev. (Riga) No. 6, Nov./Dec. 1976, pp. 3–7.

* cited by examiner

STEAM EXPLOSION TREATMENT WITH ADDITION OF CHEMICALS

This application is a continuation-in-part of application Ser. No. 09/467,216 entitled Steam Explosion Treatment With Addition of Chemicals and filed in the United States Patent and Trademark Office on Dec. 20, 1999 now abandoned, which application claims priority from application Ser. No. 60/114,284 entitled Steam Explosion Treatment With Addition Of Chemicals and filed in the United States Patent and Trademark Office on Dec. 30, 1998, now abandoned. The entirety of application Ser. No. 09/467,219 is hereby incorporated by reference.

BACKGROUND OF THE INVENTION

The use of steam or explosive decompression to disintegrate or fiberize wood fibers is well known in the art. However, due to the oxidation of wood and acid hydrolysis, steam explosion processes often result in a loss of brightness, strength and yield. Therefore, there is a need for improving the steam explosion process by minimizing one or more of these detrimental effects.

SUMMARY OF THE INVENTION

It has now been discovered that a steam explosion process can be improved by combining certain chemicals with the steam such that the high temperatures associated with the steam explosion process accelerate certain desired chemical reactions. In addition, the process of this invention is applied to individual fibers, rather than paper or wood particles, which substantially improves the effectiveness of the treatment. These individual fibers can be virgin pulp fibers or deinked fibers. The resulting modified fibers are able to form handsheets with higher bulk, less brightness reduction, less or no tensile reduction and a higher porosity.

More specifically, for example, the loss of brightness associated with conventional steam explosion processes can be improved by the addition, prior to steam explosion process, of: peroxide and caustic soda (NaOH); boric acid; free sugars and alditols such as glucitol, maltose, and maltitol; antioxidants such as ascorbic acid and 1-thioglycerol; and/or nitrogen-free complexing agents such as tartaric acid and gluconolactone.

Strength degradation can be reduced by adding monochloroacetic acid and caustic soda (NaOH) to the individual fibers prior to subjecting them to steam explosion. In addition, other chemicals can be used which contain a fiber reactive group and also contain one or more anionic groups to increase the negative charge density on the fiber surface. The fiber reactive groups which are responsible to form a covalent bond to hydroxyl groups on cellulose fiber, include groups such as monohaloalkyl, monohalotriazine, dihalotriazine, trihalopyrimidine, dihalopyridazinone, dihaloquinoxaline, dihalophtalazine, halobenzothiazole, acrylamide, vinylsulfone, beta-sulfatoethylsylfonamide, beta-chloroethylsulfone, and methylol. Suitable anionic groups include, without limitation, sulfonyl, carboxyl or salts thereof. In addition, the polymeric reactive compound (PRC), comprising a monomer with carboxylic acid groups on adjacent carbon atoms that can form cyclic anhydrides in the form of a five-membered ring could be added for strength improvement. A useful commercial compound is BELCLINE® DP 80 (FMC Corporation), which is a terpolymer of maleic acid, vinyl acetate and ethyl acetate.

In order to neutralize any acid generated in the steam explosion process of this invention, in addition to NaOH, other alkaline agents can also be applied to the fibers, such as $NaHCO_3$, $Na_2CO_3$, $Na_3PO_4$ and the like.

Hence, in one aspect the invention resides in a process for the treatment of cellulosic fibers comprising: (a) treating an aqueous slurry of individual cellulosic fibers containing brightness and/or strength enhancing chemicals with steam at super atmospheric temperature and pressure; and (b) explosively releasing the super atmospheric steam pressure to produce permanently curled fibers.

In another aspect, the invention resides in a paper sheet or an absorbent article comprising the curled fibers treated by the processes disclosed herein.

DETAILED DESCRIPTION OF THE INVENTION

A wide variety of cellulosic fibers can be employed in the process of the present invention. Illustrative sources of individual cellulosic fibers include, but are not limited to: wood fibers, such as wood pulp fibers; non-woody papermaking fibers from cotton fibers; fibers from straws and grasses, such as rice and esparto; fibers from canes and reeds, such as bagasse; fibers from bamboos; fibers from stalks with bast fibers, such as jute, flax, kenaf, cannabis, linen and ramie; and fibers from leaf fibers, such as abaca and sisal. It is also possible to use mixtures of one or more kinds of cellulosic fibers. Suitably, the individual cellulosic fibers used are from softwood sources such as pines, spruces, and firs, and hardwood sources such as oaks, eucalyptuses, poplars, beeches, and aspens.

As used herein, the term "fiber" or "fibrous" is meant to refer to a particulate material wherein the length to diameter ratio of such particulate material is 10 or greater.

It is generally desired that the cellulosic fibers used herein be wettable. As used herein, the term "wettable" is meant to refer to a fiber or material which exhibits a water-in-air contact angle of less than 90°. Suitably, the cellulosic fibers useful in the present invention exhibit a water-in-air contact angle from about 10° to about 50° and more suitably from about 20° to about 30°. Suitably, a wettable fiber refers to a fiber which exhibits a water-in-air contact angle of less than 90°, at a temperature between about 0° C. and about 100° C., and suitably at ambient conditions, such as about 23° C.

Suitable cellulosic fibers are those which are naturally wettable. However, naturally nonwettable fibers can also be used. It is possible to treat the fiber surfaces by an appropriate method to render them more or less wettable. When surface treated fibers are employed, the surface treatment is desirably nonfugitive; that is, the surface treatment desirably does not wash off the surface of the fiber with the first liquid insult or contact. For the purposes of this application, a surface treatment on a generally nonwettable fiber will be considered to be nonfugitive when a majority of the fibers demonstrate a water in air contact angle of less than 90° for three consecutive contact angle measurements, with drying between each measurement. That is, the same fiber is subjected to three separate contact angle determinations and, if all three of the contact angle determinations indicate a contact angle of water in air of less than 90°, the surface treatment on the fiber will be considered to be nonfugitive. If the surface treatment is fugitive, the surface treatment will tend to wash off of the fiber during the first contact angle measurement, thus exposing the nonwettable surface of the underlying fiber, and will demonstrate subsequent contact angle measurements greater than 90°. Suitable wettability agents include polyalkylene glycols, such as polyethylene glycols. The wettability agent is used in an amount less than about 5 weight percent, suitably less than about 3 weight percent, and more suitably less than about 2 weight percent, of the total weight of the fiber, material, or absorbent structure being treated.

It is desired that the cellulosic fibers be used in a form wherein the cellulosic fibers have already been refined into a pulp. As such, the cellulosic fibers will be substantially in the form of individual cellulosic fibers although such individual cellulosic fibers may be in an aggregate form such as a pulp sheet. The current process, then, is in contrast to known steam explosion processes that generally treat cellulosic fibers that are typically in the form of virgin wood chips or the like. Thus, the current process is a post-pulping, or post deinking, cellulosic fiber modifying process as compared to known steam explosion processes that are generally used for high-yield pulp manufacturing or waste-recycle processes.

The cellulosic fibers used in the steam explosion process of this invention are desirably low yield cellulosic fibers. As used herein, "low yield" cellulosic fibers are those cellulosic fibers produced by pulping processes providing a yield of 85 percent or less, suitably about 80 percent or less, and more suitably about 55 percent or less. In contrast, "high yield" cellulosic fibers are those cellulosic fibers produced by pulping processes providing a yield greater than 85 percent. Such pulping processes generally leave the resulting cellulosic fibers with high levels of lignin.

In general, the cellulosic fibers may be treated with chemicals in either a dry or a wet state. However, it may be desirable to first prepare an aqueous mixture or slurry of the cellulosic fibers wherein the aqueous mixture is agitated, stirred, or blended to effectively disperse the cellulosic fibers throughout the water. Accordingly, it is desired that the aqueous mixture have a consistency of from about 10 to 100 weight percent, suitably from about 25 to about 80 weight percent and more suitably from about 55 to about 75 weight percent cellulosic fibers, based on the total weight percent of the aqueous pulp mixture. (As used herein, "consistency" refers to the concentration of the cellulosic fibers present in an aqueous mixture. As such, the consistency is a weight percent representing the weight amount of the cellulosic fibers present in an aqueous mixture divided by the total weight amount of cellulosic fibers and water present in such mixture, multiplied by 100.)

A dewatering means can be used to thicken the aqueous mixture to the desirable consistency. Dewatering means that are suitable for use in the present invention include, but are not limited to, typical equipment used to thicken pulp slurry or sludge slurry such as twin wire press, screw press, belt washer or double nip thickener. Such thickening equipment is well known and is described in various pulp and paper journals and textbooks. To dewater the pulp slurry beyond 60 weight percent consistency, thermal drying processes can be used. An example of a direct thennal drying system is a convection dryer, where hot air or flue gases flow over the pulp slurry and purge the water from the pulp slurry. Among the convection drying processes in the paper industry are drum dryers, belt dryers or rack dryers.

Chemical addition, such as the addition of brightening agents and/or strength agents, is suitably introduced to the concentrated fiber pulp slurry. A mixing means can be used to mix the brightening agent or strength agent as needed prior to feeding the fiber slurry to the steam explosion reactor. Mixing means that are suitable for this purpose include typical equipment used to mix bleaching chemicals with pulp slurries, such as medium consistency or high consistency mixers available from Ingersoll-Rand, Impco, Andriz and Sunds Defibrator. Such mixing equipment is well known and is described in various pulp and paper journals and textbooks.

The aqueous mixture of fibers and chemicals is then fed to a suitable steam explosion reactor. Such reactors are well known in the art. Suitable equipment and methods for steam explosion may be found, for example, in Canadian Patent No. 1,070,537, dated Jan. 29, 1980; Canadian Patent No. 1,070,646, dated Jan. 29, 1980; Canadian Patent No. 1,119,033, dated Mar. 2, 1982; Canadian Patent No. 1,138,708, dated Jan. 4, 1983; and U.S. Pat. No. 5,262,003, issued Nov. 16, 1993, all of which are incorporated herein in their entirety by reference.

In carrying out the steam explosion process, it is desired that the cellulosic fibers and chemicals are cooked in a saturated steam environment that is substantially free of air. The presence of air in the pressurized cooking environment may result in the oxidation of the cellulosic fibers. As such, it is desired that the cellulosic fibers are cooked in a saturated steam environment that comprises less than about 5 weight percent, suitably less than about 3 weight percent, and more suitably less than about 1 weight percent of air, based on the total weight of the gaseous environment present in the pressurized cooking environment.

The individual cellulosic fibers are steam cooked at a high temperature and at a high pressure in the presence of the added chemicals. In general, any combination of high pressure, high temperature, and time which is effective in achieving a desired degree of modification, without undesirable damage to the cellulosic fibers, so that the cellulosic fibers exhibit the desired liquid absorbency properties as described herein, is suitable for use in the present invention.

Generally, if the temperature used is too low, there will not be a substantial and/or effective amount of modification of the cellulosic fibers that occurs. Also, generally, if the temperature used is too high, a substantial degradation of the cellulosic fibers may occur which will negatively affect the properties exhibited by the treated cellulosic fibers. As such, as a general rule, the cellulosic fibers will be treated at a temperature within the range from about 130° C. to about 250° C., suitably from about 150° C. to about 225° C., more suitably from about 160° C. to about 225° C., and most suitably from about 160° C. to about 200° C.

Generally, the cellulosic fibers and chemicals will be subjected to an elevated superatmospheric pressure over a time period within the range of from about 0.1 minute to about 30 minutes, beneficially from about 0.5 minute to about 20 minutes, and suitably from about 1 minute to about 10 minutes. In general, the higher the temperature employed, the shorter the period of time generally necessary to achieve a desired degree of modification of the cellulosic fibers. As such, it maybe possible to achieve essentially equivalent amounts of modification for different cellulosic fiber samples by using different combinations of high temperatures and times.

Generally, if the pressure used is too low, there will not be a substantial and/or effective amount of modification of the cellulosic fibers that occurs. Also, generally, if the pressure used is too high, a substantial degradation of the cellulosic fibers may occur which will negatively affect the properties exhibited by the crosslinked cellulosic fibers. As such, as a general rule, the cellulosic fibers will be treated at a pressure that is superatmospheric (i.e. above normal atmospheric pressure), within the range from about 40 to about 405 pounds per square inch, suitably from about 40 to about 230 pounds per square inch, and more suitably from about 90 to about 230 pounds per square inch.

After steam cooking the cellulosic fibers, the pressure is released and the cellulosic fibers are exploded into a release vessel. The steam explosion process generally causes the cellulosic fibers to become modified. Without intending to be bound hereby, it is believed that the steam explosion process causes the cellulosic fibers to undergo a curling phenomenon. The steam exploded cellulosic fibers, in addition to being modified, have been discovered to exhibit improved properties that make such steam exploded cellulosic fibers suitable for use in liquid absorption or liquid handling applications.

In one embodiment of the present invention, the cellulosic fibers will be considered to be effectively treated by the steam explosion process when the cellulosic fibers exhibit a Wet Curl Index (hereinafter defined) of about 0.2 or greater, more specifically from about 0.2 to about 0.4, more specifically from about 0.2 to about 0.35, more specifically from about 0.22 to about 0.33, and more specifically from about 0.25 to about 0.33. In contrast, cellulosic fibers that have not been treated generally exhibit a Wet Curl Index that is less than about 0.2.

After the cellulosic fibers have been effectively steam exploded, the treated cellulosic fibers are suitable for use in a wide variety of applications. However, depending on the use intended for the treated cellulosic fibers, such treated cellulosic fibers may be washed with water. If any additional processing procedures are planned because of the specific use for which the treated cellulosic fibers are intended, other recovery and post-treatment steps are also well known.

The cellulosic fibers treated according to the process of the present invention are suited for use in disposable absorbent products such as diapers, adult incontinent products, and bed pads; in catamenial devices such as sanitary napkins, and tampons; other absorbent products such as wipes, bibs, wound dressings, and surgical capes or drapes; and tissue-based products such as facial or bathroom tissues, household towels, wipes and related products.

Test Procedures

Wet Curl Index

The curl of a fiber may be quantified by a measuring the fractional shortening of a fiber due to kink, twists, and/or bends in the fiber. For the purposes of this invention, a fiber's curl value is measured in terms of a two dimensional plane, determined by viewing the fiber in a two dimensional plane. To determine the curl value of a fiber, the projected length of a fiber, "$L_1$", which is the longest dimension of a two-dimensional rectangle encompassing the fiber, and the actual length of the fiber, "L", are both measured. An image analysis method may be used to measure L and $L_1$. A suitable image analysis method is described in U.S. Pat. No. 4,898,642, incorporated herein by reference in its entirety. The curl value of a fiber can then be calculated from the following equation:

$$\text{curl value}=(L/L_1)-L_1.$$

Depending on the nature of the curl of a cellulosic fiber, the curl may be stable when the cellulosic fiber is dry but may be unstable when the cellulosic fiber is wet. The cellulosic fibers prepared according to the process of the present invention have been found to exhibit a substantially stable fiber curl when wet. This property of the cellulosic fibers may be quantified by a Wet Curl Index value, as measured according to the test method described herein, which is a length-weighted mean average of the curl value for a designated number of fibers, such as about 4000 fibers, from a fiber sample. As such, the Wet Curl Index is the summation of the individual wet curl values for each fiber multiplied by the fiber's actual length, L, and divided by the summation of the actual lengths of the fibers. It is hereby noted that the Wet Curl Index, as determined herein, is calculated by only using the necessary values for those fibers with a length of greater than about 0.4 millimeter.

The Wet Curl Index for fibers is determined by using an instrument which rapidly, accurately, and automatically determines the quality of fibers, the instrument being available from OpTest Equipment Inc., Hawkesbury, Ontario, Canada, under the designation Fiber Quality Analyzer, OpTest Product Code DA93. Specifically, a sample of dried cellulosic fibers to be measured is poured into a 600 milliliter plastic sample beaker to be used in the Fiber Quality Analyzer. The fiber sample in the beaker is diluted with tap water until the fiber concentration in the beaker is about 10 to about 25 fibers per second for evaluation by the Fiber Quality Analyzer.

An empty plastic sample beaker is filled with tap water and placed in the Fiber Quality Analyzer test chamber. The <System Check> button of the Fiber Quality Analyzer is then pushed. If the plastic sample beaker filled with tap water is properly placed in the test chamber, the <OK> button of the Fiber Quality Analyzer is then pushed. The Fiber Quality Analyzer then performs a self-test. If a warning is not displayed on the screen after the self-test, the machine is ready to test the fiber sample.

The plastic sample beaker filled with tap water is removed from the test chamber and replaced with the fiber sample beaker. The <Measure> button of the Fiber Quality Analyzer is then pushed. The <New Measurement> button of the Fiber Quality Analyzer is then pushed. An identification of the fiber sample is then typed into the Fiber Quality Analyzer. The <OK> button of the Fiber Quality Analyzer is then pushed. The <Options> button of the Fiber Quality Analyzer is then pushed. The fiber count is set at 4,000. The parameters of scaling of a graph to be printed out may be set automatically or to desired values. The <Previous> button of the Fiber Quality Analyzer is then pushed. The <Start> button of the Fiber Quality Analyzer is then pushed. If the fiber sample beaker was properly placed in the test chamber, the <OK> button of the Fiber Quality Analyzer is then pushed. The Fiber Quality Analyzer then begins testing and displays the fibers passing through the flow cell. The Fiber Quality Analyzer also displays the fiber frequency passing through the flow cell, which should be about 10 to about 25 fibers per second. If the fiber frequency is outside of this range, the <Stop> button of the Fiber Quality Analyzer should be pushed and the fiber sample should be diluted or have more fibers added to bring the fiber frequency within the desired range. If the fiber frequency is sufficient, the Fiber Quality Analyzer tests the fiber sample until it has reached a count of 4000 fibers, at which time the Fiber Quality Analyzer automatically stops. The <Results> button of the Fiber Quality Analyzer is then pushed. The Fiber Quality Analyzer calculates the Wet Curt value of the fiber sample, which prints out by pushing the <Done> button of the Fiber Quality Analyzer.

Preparation of Wet-Laid Handsheet

A) Handsheet Forming:

A 7½ inch by 7½ inch handsheet has a basis weight of about 60 grams per square meter and was prepared using a Valley Handsheet mold, 8×8 inches. The sheet mold forming wire is a 90×90 mesh, stainless steel wire cloth, with a wire diameter of 0.0055 inches. The backing wire is a 14"×14" mesh with a wire diameter of 0.021 inches, plain weave bronze. Taking a sufficient quantity of the thoroughly mixed stock to produce a handsheet of about 60 grams per square meter. Clamp the stock container of the sheet mold in position on the wire and allow several inches of water to rise above the wire. Add the measured stock and then fill the mold with water up to a mark of 6 inches above the wire. Insert the perforated mixing plate into the mixture in the mold and slowly move it down and up 7 times. Immediately open the water leg drain valve. When the water and stock mixture drains down to and disappears from the wire, close the drain valve. Raise the cover of the sheet mold. Carefully place a clean, dry blotter on the formed fibers. Place the dry couch roll at the front edge of the blotter. The fibers adhering to the blotter, are couched off the wire by one passage of the couching roll, without pressure, from front to back of wire.

B) Handsheet Pressing:

Place the blotter with the fiber mat adhering to it in the hydraulic press, handsheet up, on top of tow used, re-dried blotters. Two new blotters are placed on top of the handsheet. Close the press, clamp it and apply pressure to give a gauge reading that will produce 75 PSI on the area of the blotter affected by the press. Maintain this pressure for exactly one minute. Release the pressure on the press, open the press and remove the handsheet.

C) Handsheet Drying:

Place the handsheet on the polished surface of the sheet dryer (Valley Steam hot plate). Carefully lower the canvas cover over the sheet and fasten the 13 lb. dead weight to the lead filled brass tube. Allow the sheet to dry for 2 minutes. The surface temperature, with cover removed, should average 100.5 plus or minus 1 degree C. Remove the sheet from the dryer and trim to the 7½ inch×7½ inch. Weigh the sheet immediately.

Testing of Handsheets

Handsheets shall all be tested at the standard 50% humidity and 73 degree F. temperature basis.

Bulk

The Bulk of the handsheets is determined according to TAPPI (Technical Association of Pulp and Paper Industry) test method (T220 om-88).

Brightness

The Brightness of the handsheets is determined in accordance with TAPPI test method T525 om-92.

Tensile Index

The Tensile Index of the handsheets is determined in accordance with TAPPI (Technical Association of Pulp and Paper Industry) test method (T220 om-88).

Dry Tensile Strength

The Dry Tensile Strength is determined by in accordance with TAPPI test method T220 om-88, but reported in the unit of grams/in.

Wet Tensile Strength

The Wet Tensile Strength is determined by the same procedures for dry tensile strength test as described above, but with the following modifications:

1. Pour distilled water to about ½–¾ inch depth in the container. Maintain this depth when testing numerous specimens.
2. When testing handsheets, from an open loop by holding each end of the test strip and carefully lowering the specimen until the lowermost curve of the loop touches the surface of the water without allowing the inner side of the loop to come together.
3. Touch the lowermost point of the curve on the handsheet to the surface of the distilled water in such a way that the wetted area on the inside of the loop extends at least 1 inch and not more than 1.5 inches lengthwise on the strip and is uniformed across the width of the strip. Do not wet the strip twice. Do not allow the opposite sides of the loop to touch each other or the sides of the container.
4. Remove the excess water from the test specimen by touching the wetted area to a blotter. Blot the specimen only once. Blotting more than once will cause fiber damage and too much moisture to be removed.
5. To avoid excess wicking, immediately insert the test specimen into the tensile tester so the jaws are clamped to the dry areas of the strip with the wet area about midway between the jaws.

EXAMPLES

Example 1

(Prior Art).

A dried northern softwood kraft pulp (available from Kimberly-Clark Corporation under the designation LL-19) was made into a slurry and dewatering to form a mixture having a consistency of about 30% weight percent cellulosic fibers with a laboratory centrifuge. The said fibers were dried to 75% consistency using an oven set at 50 degree C. Samples of about 200 grams, based on a dry basis of cellulosic fibers, were added to a laboratory steam explosion reactor, available from Stake Tech., Canada. The reactor had a capacity of 2 liters. After closing the top valve, saturate steam at 200 degree C. was injected into the reactor. The pulp fibers were directly contacted with the steam for 2 minutes. The cellulosic fibers were then explosively decompressed and discharged to a container by opening the bottom valve. The steam-exploded fibers were collected for evaluation.

The cellulosic fiber samples of steam-explosion treated fibers and untreated control fiber samples were formed into handsheet according to procedure described herein and the formed handsheets were evaluated for Bulk and Tensile Index. The Wet Curl Index of the steam-explosion treated and untreated fibers were also measured. The results of these evaluations are summarized in Table 1.

TABLE 1

| | Bulk (cm^3/gram) | Tensile Index (Nm/grams) | Brightness | Wet Curl Index |
|---|---|---|---|---|
| control | 2.39 | 20.97 | 88.6 | 0.11 |
| Steam-explosion treated | 2.73 | 12.87 | 84.4 | 0.22 |

This example demonstrates that the conventional steam explosion treatment increases bulk, decreases tensile strength and decreases brightness.

Example 2

(Invention).

A wet lap of de-ink fibers (available from Ponderosa Recycle Fiber) was dried to 80% consistency using an oven set at 80 degree C. Samples of about 200 grams, based on a dry basis of cellulosic fibers, were mixed with 0.5% peroxide (H2O2) and 0.2% caustic soda (NaOH) [based on a dry basis of fibers] and resulting a mixture of fibers and chemicals at 50% consistency. The said mixture was added to a laboratory steam explosion reactor, available from Stake Tech., Canada. The reactor had a capacity of 2 liters. After closing the top valve, saturate steam at 200 degree C. was injected into the reactor. The pulp fibers were directly contacted with the steam for 2 minutes. The cellulosic fibers were then explosively decompressed and discharged to a container by opening the bottom valve. The steam-exploded fibers were collected for evaluation.

Additional samples mixtures having peroxide addition from 1% to 3% and caustic soda addition from 0.4% to 0.8%were prepared.

The cellulosic fiber samples of steam-explosion treated fibers and untreated control fiber samples were formed into handsheet according to procedure described herein and the formed handsheets were evaluated for Bulk and Tensile Index. The results of these evaluations are summarized in Table 2.

TABLE 2

| | control | Steam explosion | Steam explosion with chemicals | Steam explosion with chemicals | Steam explosion with chemicals | Steam explosion with chemicals |
|---|---|---|---|---|---|---|
| Peroxide, % | 0 | 0 | 0.5 | 1 | 2 | 3 |
| Caustic Soda, % | 0 | 0 | 0.2 | 0.4 | 0.6 | 0.8 |
| Bulk, (cm^3/g) | 2.23 | 2.47 | 2.38 | 2.39 | 2.37 | 2.39 |
| Tensile Index, (NM/g) | 32.01 | 22.72 | 28.33 | 23.94 | 22.79 | 23.83 |
| Brightness | 81.93 | 72.7 | 80.35 | 80.75 | 80.06 | 80.47 |

This example shows reduced brightness reduction.

Example 3

(Invention).

A wet lap of de-ink fibers (available from Ponderosa Recycle Fiber) were mixed with 2% and 4% boric acid, based on a dry basis of fibers, and resulting a mixture of fibers and chemicals at 30% consistency. Samples of about 200 grams, based on a dry basis of cellulosic fibers, Then the said mixture was added to a laboratory steam explosion reactor, available from Stake Tech., Canada. The reactor had a capacity of 2 liters. After closing the top valve, saturate steam at 200 degree C. was injected into the reactor. The pulp fibers were directly contacted with the steam for 4 minutes. The cellulosic fibers were then explosively decompressed and discharged to a container by opening the bottom valve. The steam-exploded fibers were collected for evaluation. The results are summarized in Table 3.

TABLE 3

| | Code 1 | Code 2 | Code 3 | Code 3 |
|---|---|---|---|---|
| Steam explosion | No (as control) | yes | Yes | yes |
| Boric acid, % | 0 | 0 | 2 | 4 |
| Brightness, % | 84.94 | 78.49 | 81.3 | 81.05 |

This example shows improved brightness with the addition of boric acid compared to the steam-exploded sample without boric acid addition.

Example 4

(Invention).

A dried northern softwood kraft pulp (available from Kimberly-Clark Corporation under the designation LL-19) was made into a slurry and dewatering to form a mixture having a consistency of about 30% weight percent cellulosic fibers with a laboratory centrifuge. Samples of about 200 grams, based on a dry basis of cellulosic fibers, were mixed with 8.6% monochloroacetic acid sodium salt and 2.2% caustic soda [based on a dry basis of fibers] and resulting a mixture of fibers and chemicals at 20% consistency. The mixture was retained in a container for 2 hours at room temperature. Then the said mixture was added to a laboratory steam explosion reactor, available from Stake Tech., Canada. The reactor had a capacity of 2 liters. After closing the top valve, saturate steam at 160 degree C. was injected into the reactor. The pulp fibers were directly contacted with the steam for 2 minutes. The cellulosic fibers were then explosively decompressed and discharged to a container by opening the bottom valve. The steam-exploded fibers were collected for evaluation. One percent of Kymene (wet strength agent available from Hercules Corp.) based on dry weight of fiber was added to the fiber before handsheets were made. The results are summarized in Table 4.

TABLE 4

| | Control* | Code 1 | Code 2 | Code 3 | Code 4 | Code 4 | Code 5 |
|---|---|---|---|---|---|---|---|
| NaOH | 0 | 2.2 | 3 | 4.4 | 5.9 | 6.7 | 8.9 |
| ClCH2COONa | 0 | 8.6 | 8.6 | 17.2 | 17.2 | 25.8 | 25.8 |
| Bulk (cm^3/g) | 2.25 | 2.84 | 2.84 | 2.88 | 2.84 | 2.8 | 2.8 |
| Dry Tensile strength, (g/in) | 4754 | 4716 | 4488 | 4772 | 4732 | 4870 | 5028 |
| Wet Tensile strength, (g/in) | 1179 | 1396 | 1431 | 1422 | 1410 | 1534 | 1604 |
| Ratio of Wet/Dry tensile, % | 24.8 | 29.6 | 31.9 | 29.8 | 31.2 | 31.5 | 31.9 |

*The control sample was not subjected to steam explosion treatment.

This example shows maintenance of strength and increased bulk, as well as an increase in the ratio of the Wet Tensile Strength to the Dry Tensile Strength.

The foregoing examples, given for purposes of illustration, are not to be construed as limiting the scope of the invention which is defined by the following claims and all equivalents thereto.

We claim:

1. A process for the treatment of cellulosic fibers comprising:

(a) treating an aqueous slurry of individual cellulosic fibers and boric acid with steam at superatmospheric temperature and pressure, wherein said fibers are selected from the group consisting of kraft fibers and deinked fibers; and (b) explosively releasing the superatmospheric steam pressure to produce curled fibers.

2. The process of claim 1 wherein the aqueous slurry has a consistency of from about 10 to 100 percent.

3. The process of claim 1 wherein the aqueous slurry has a consistency of from about 25 to about 80 percent.

4. The process of claim 1 wherein the aqueous slurry has a consistency of from about 55 to about 75 percent.

5. The process of claim 1 wherein the fibers are treated at a temperature of from about 130° C. to about 250° C.

6. The process of claim 1 wherein the fibers are treated at a temperature of from about 150° C. to about 225° C.

7. The process of claim 1 wherein the fibers are treated at a temperature of from about 160° C. to about 225° C.

8. The process of claim 1 wherein the fibers are treated at a temperature of from about 160° C. to about 200° C.

9. The process of claim 1 wherein the fibers are treated at a pressure of from about 40 to about 405 pounds per square inch.

10. The process of claim 1 wherein the fibers are treated at a pressure of from about 40 to about 230 pounds per square inch.

11. The process of claim 1 wherein the fibers are treated at a pressure of from about 90 to about 230 pounds per square inch.

12. The process of claim 1 wherein the resulting curled fibers have a Wet Curl Index of about 0.2 or greater.

13. The process of claim 1 wherein the resulting curled fibers have a Wet Curl Index of from about 0.2 to about 0.4.

14. The process of claim 1 wherein the resulting curled fibers have a Wet Curl Index of from about 0.2 to about 0.35.

15. The process of claim 1 wherein the resulting curled fibers have a Wet Curl Index of from about 0.22 to about 0.33.

16. The process of claim 1 wherein the resulting curled fibers have a Wet Curl Index of from about 0.25 to about 0.33.

* * * * *